US010347223B2

(12) United States Patent
Taniguchi

(10) Patent No.: US 10,347,223 B2
(45) Date of Patent: Jul. 9, 2019

(54) KEYBOARD DEVICE AND KEYBOARD INSTRUMENT

(71) Applicant: CASIO COMPUTER CO., LTD., Shibuya-ku, Tokyo (JP)

(72) Inventor: Hirokazu Taniguchi, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/919,920

(22) Filed: Mar. 13, 2018

(65) Prior Publication Data

US 2018/0268786 A1 Sep. 20, 2018

(30) Foreign Application Priority Data

Mar. 16, 2017 (JP) ..... 2017-051926

(51) Int. Cl.
*G10C 3/04* (2006.01)
*G10C 3/12* (2006.01)

(52) U.S. Cl.
CPC *G10C 3/04* (2013.01); *G10C 3/12* (2013.01)

(58) Field of Classification Search
CPC ..... G10C 3/04; G10C 3/12
See application file for complete search history.

(56) References Cited

U.S. PATENT DOCUMENTS 476,766 A * 6/1892 Kringle ..... G10C 3/12 84/440
6,423,889 B2 7/2002 Inoue
6,649,821 B2 * 11/2003 Inoue ..... G10C 3/12 84/423 R
6,683,242 B2 1/2004 Inoue et al.
6,888,052 B2 * 5/2005 Meisel ..... G10C 3/12 84/16
7,145,062 B2 * 12/2006 Ishida ..... G10C 3/12 84/35
7,193,147 B2 3/2007 Ishida
(Continued)

FOREIGN PATENT DOCUMENTS

JP 62502781 A 10/1987
JP 07261749 A 10/1995
(Continued)

OTHER PUBLICATIONS

Office Action (Non-Final Rejection) dated Feb. 21, 2019 issued in U.S. Appl. No. 15/920,084.
(Continued)

*Primary Examiner* — Robert W Horn
(74) *Attorney, Agent, or Firm* — Holtz, Holtz & Volek PC

(57) ABSTRACT

A keyboard device where at least one of a transmission rail and a hammer rail is favorably supported, and a keyboard instrument including the keyboard device are provided. A transmission support pole for supporting the transmission rail and a hammer support pole for supporting the hammer rail are each arranged in a gap between two keys adjacent to each other among a plurality of keys, arranged in a hole provided in at least one of the plurality of keys, or arranged at a position corresponding to a key support shaft which supports at least one of the plurality of keys. As a result, at least one of the transmission support rail and the hammer support rail is favorably supported.

13 Claims, 10 Drawing Sheets

(56) References Cited

U.S. PATENT DOCUMENTS

| | | | | |
|---|---|---|---|---|
| 7,345,235 | B2 * | 3/2008 | Izutani | G10C 3/12 84/718 |
| 7,807,911 | B2 * | 10/2010 | Izutani | G10C 3/12 411/451.1 |
| 7,999,162 | B2 | 8/2011 | Izutani et al. | |
| 8,541,673 | B2 | 9/2013 | Jones et al. | |
| 9,006,549 | B2 | 4/2015 | Suzuki et al. | |
| 9,324,306 | B2 | 4/2016 | Hoshino et al. | |
| 9,384,715 | B2 | 7/2016 | Taniguchi | |
| 9,495,940 | B2 | 11/2016 | Hoshino et al. | |
| 9,607,587 | B2 | 3/2017 | Suzuki et al. | |
| 2006/0207404 | A1 | 9/2006 | Izutani et al. | |
| 2014/0083274 | A1 | 3/2014 | Abe | |
| 2018/0268786 | A1 * | 9/2018 | Taniguchi | G10C 3/04 |
| 2018/0268787 | A1 | 9/2018 | Taniguchi | |
| 2019/0019484 | A1 | 1/2019 | Taniguchi et al. | |

FOREIGN PATENT DOCUMENTS

| | | | |
|---|---|---|---|
| JP | 10039857 | A | 2/1998 |
| JP | 2002258835 | A | 9/2002 |
| JP | 2005049789 | A | 2/2005 |
| JP | 2008090167 | A | 4/2008 |
| JP | 2015079268 | A | 4/2015 |

OTHER PUBLICATIONS

Related U.S. Appl. No. 15/920,084; First Named Inventor: Hirokazu Taniguchi; Title: "Keyboard Device and Keyboard Instrument"; filed: Mar. 13, 2018.

* cited by examiner

KEYBOARD DEVICE AND KEYBOARD INSTRUMENT

CROSS-REFERENCE TO RELATED APPLICATION

This application is based upon and claims the benefit of priority from the prior Japanese Patent Application No. 2017-051926, filed Mar. 16, 2017, the entire contents of which are incorporated herein by reference.

BACKGROUND OF THE INVENTION

1. Field of the Invention

The present invention relates to a keyboard device for use in a keyboard instrument such as a piano, and a keyboard instrument including the keyboard device.

2. Description of the Related Art

For example, a keyboard device such as a piano is known which includes a wippen that is rotated by a key depression operation, a jack that is driven in response to the rotating motion of the wippen, and a hammer member that is driven by the jack and strikes a string, and in which the wippen, the jack, and the hammer member are supported on a base member with them being arranged corresponding to each key of plural keys, as described in Japanese Patent Application Laid-Open (Kokai) Publication No. 2002-258835.

This type of keyboard device includes a wippen rail which holds the plurality of wippens arranged corresponding to the plurality of keys and a hammer rail which holds the plurality of hammer members arranged corresponding to the plurality of keys, and the end portions of the wippen rail and the end portions of the hammer rail are respectively supported above the base member by rail support members.

In this case, the rail support members include fixing sections fixed on the base member and positioned to the sides of the plurality of keys, wippen rail mounting sections which are integrally provided on the fixing sections and in which the end portions of the wippen rail are mounted, and hammer rail mounting sections which are integrally provided on the fixing section and in which the end portions of the hammer rail are mounted.

In the structure of this keyboard device where the end portions of the wippen rail and the end portions of the hammer rail are supported by the rail support members fixed on the base member and positioned to the sides of the plurality of keys, the wippen rail and the hammer rail can be favorably supported. However, there is a need for a structure by which a wippen rail and a hammer rail, can be favorably supported in a more compact keyboard device.

SUMMARY OF THE INVENTION

An object of the present invention is to provide a keyboard device where at least one of a transmission rail and a hammer rail is favorably supported and a keyboard instrument including the keyboard device.

In accordance with one aspect of the present invention, there is provided a keyboard device comprising: a plurality of keys; a transmission rail which holds a plurality of transmission members that are rotated in response to key depression operations on the plurality of keys, along an array direction of the keys; and a transmission support pole which supports the transmission rail, wherein the transmission support pole is (i) arranged in a gap between two keys adjacent to each other among the plurality of keys, (ii) arranged in a hole provided in at least one of the plurality of keys, or (iii) arranged at a position corresponding to a key support shaft which supports at least one of the plurality of keys.

In accordance with another aspect of the present invention, there is provided a keyboard device comprising: a plurality of keys; a hammer rail which holds a plurality of hammer members that are rotated in response to key depression operations on the plurality of keys along an array direction of the keys; and a hammer support pole which supports the hammer rail, wherein the hammer support pole is (i) arranged in a gap between two keys adjacent to each other among the plurality of keys (ii) arranged in a hole provided in at least one of the plurality of keys, or (iii) arranged at a position corresponding to a key support shaft which supports at least one of the plurality of keys.

In accordance with still another aspect of the present invention, there is provided a keyboard device comprising a plurality of keys; a transmission rail which holds a plurality of transmission members that are rotated in response to key depression operations on the plurality of keys along an array direction of the keys; and a transmission support pole which supports the transmission rail, a hammer rail which holds a plurality of hammer members that are rotated in response to the key depression operations on the plurality of keys, along the array direction of the keys; and a hammer support pole which supports the hammer rail, wherein the transmission support pole is (i) arranged in a gap between two keys adjacent to each other among the plurality of keys, (ii) arranged in a hole provided in at least one of the plurality of keys, or (iii) arranged at a position corresponding to a key support shaft which supports at least one of the plurality of keys, and wherein the hammer support pole is (i) arranged in a gap between two keys adjacent to each other among the plurality of keys (ii) arranged in a hole provided in at least one of the plurality of keys, or (iii) arranged at a position corresponding to a key support shaft which supports at least one of the plurality of keys.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present invention can be more clearly understood by the detailed description below being considered together with the following drawings.

FIG. 5A and FIG. 5B are diagrams each showing the main portion of each key in an area where the transmission support pole or the hemmer support pole is arranged in the keyboard device shown in FIG. 3, of which FIG. 5A is an enlarged planar view showing first notch sections between which the transmission support pole is arranged, and FIG. 5B is an enlarged planar view showing second notch sections between which the hammer support pole is arranged;

FIG. 6A and FIG. 6B are diagrams showing portions of a transmission member and a transmission holding member shown in FIG. 1, of which FIG. 6A is an enlarged planar view thereof and FIG. 4B is an enlarged sectional view of the main section thereof taken along line B-B in FIG. 6A;

FIG. 7A and FIG. 7B are diagrams showing the transmission member shown in FIG. 1, of which FIG. 7A is an enlarged side view thereof, and FIG. 7B is an enlarged sectional view thereof taken along line C-C in FIG. 7A;

FIG. 8A and FIG. 8B are diagrams showing portions of a hammer member and a hammer holding member shown in FIG. 1, of which FIG. 8A is an enlarged plan view thereof, and FIG. 8B is an enlarged sectional view of the main section thereof taken along line D-D in FIG. 8A;

FIG. 9A and FIG. 9B are diagrams showing the hammer member shown in FIG. 1, of which FIG. 9A is an enlarged side view thereof, and FIG. 9B is an enlarged plan view thereof.

DETAILED DESCRIPTION OF THE PREFERRED EMBODIMENTS

An embodiment of an electronic keyboard instrument in which the present invention has been applied will hereinafter be described with reference to FIG. 1 to FIG. 9.

Figure 1:
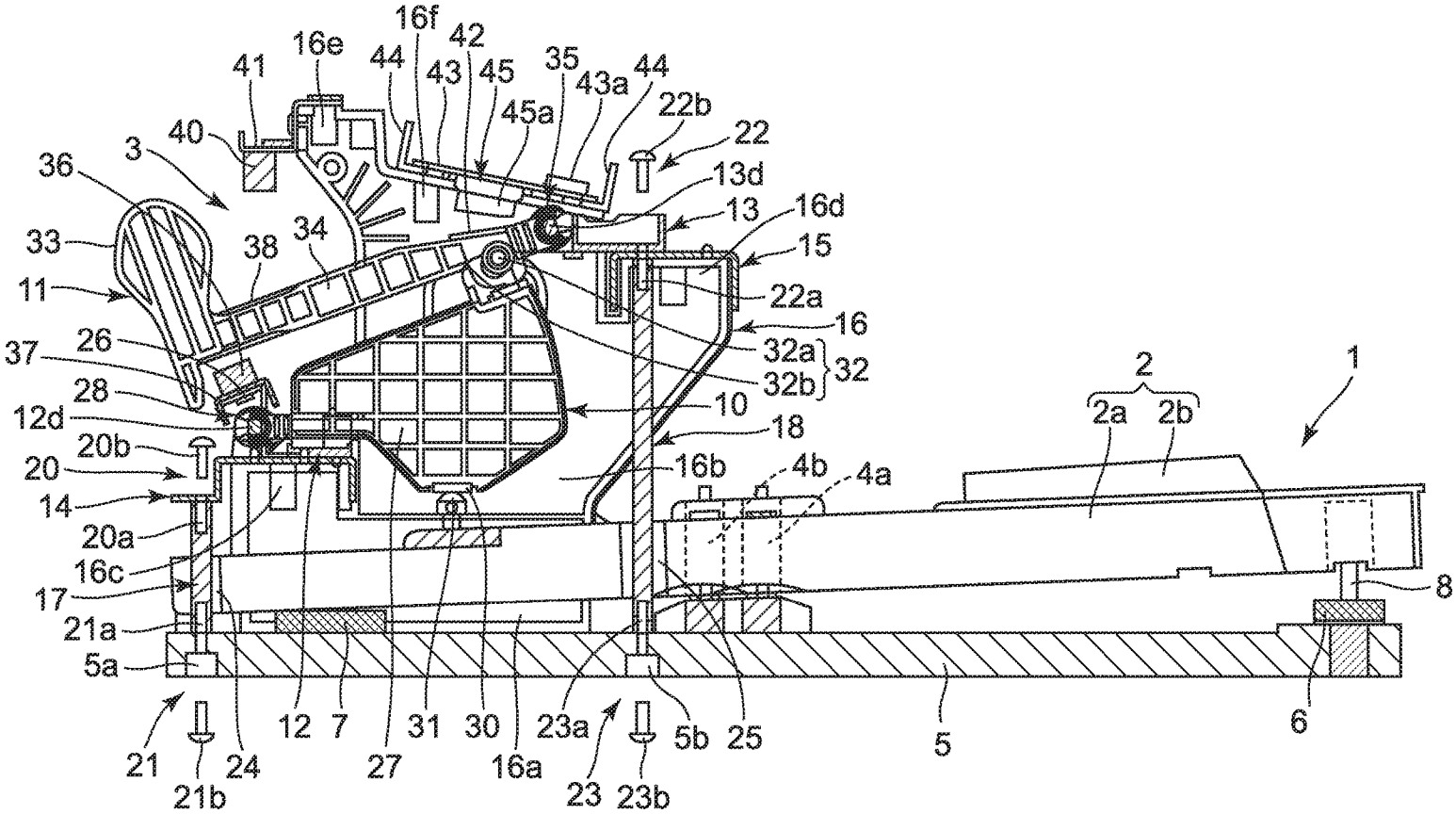
FIG. 1 is a cross-sectional view showing a keyboard device in an electronic keyboard instrument in which the present invention has been applied.

This electronic keyboard instrument includes a keyboard device 1, as shown in FIG. 1. This keyboard device 1, which is incorporated into an instrument case (not shown), includes a plurality of keys 2 arranged in parallel and action mechanisms 3 each of which applies an action load to the corresponding one of the plurality of keys 2 in response to a key depression operation on the corresponding key 2.

Figure 2:
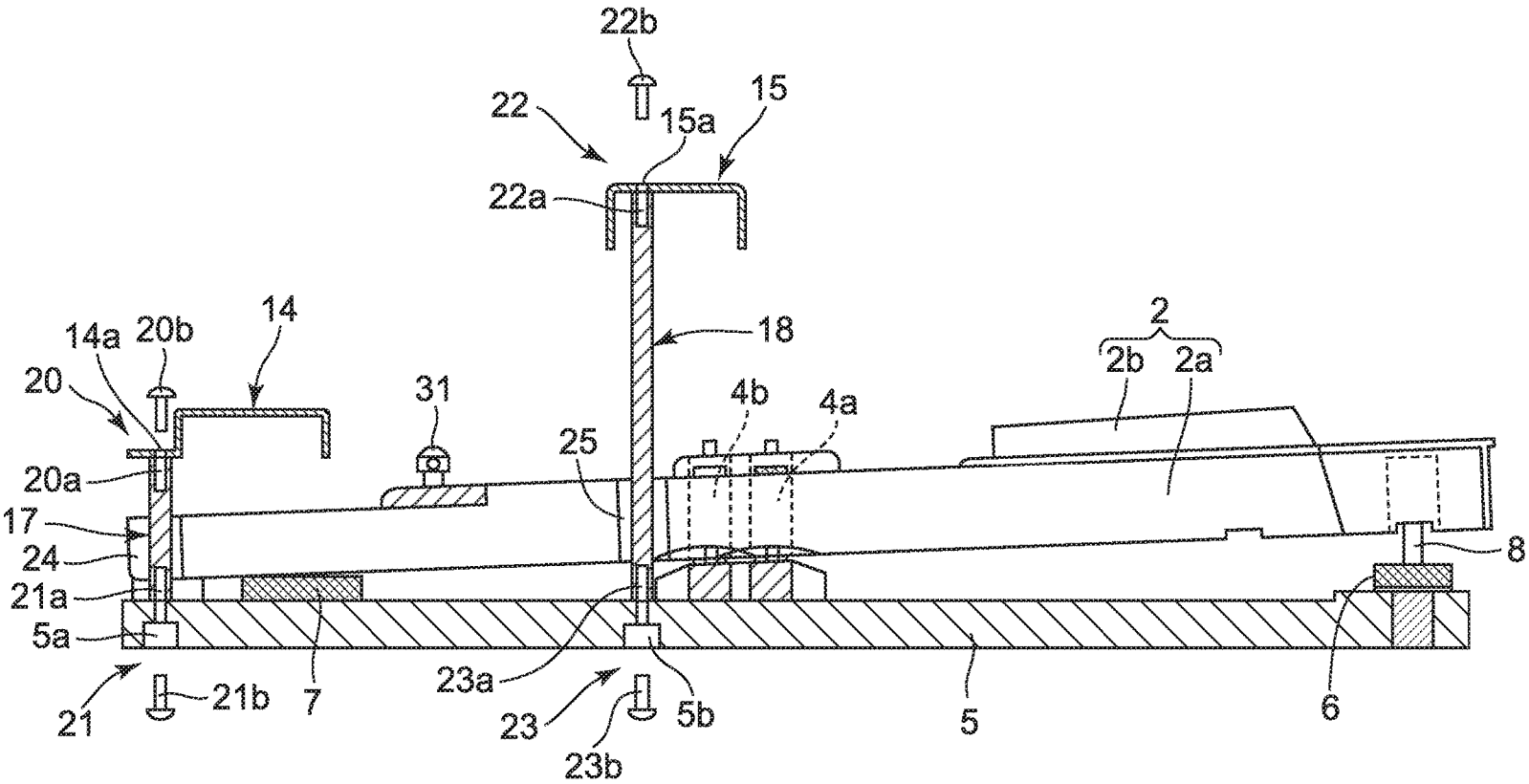
FIG. 2 is a cross-sectional view of the main section of the keyboard device shown in FIG. 1, in which a transmission support pole and a hammer support pole have been mounted on a base plate having a plurality of keys arranged thereon.
Figure 3:
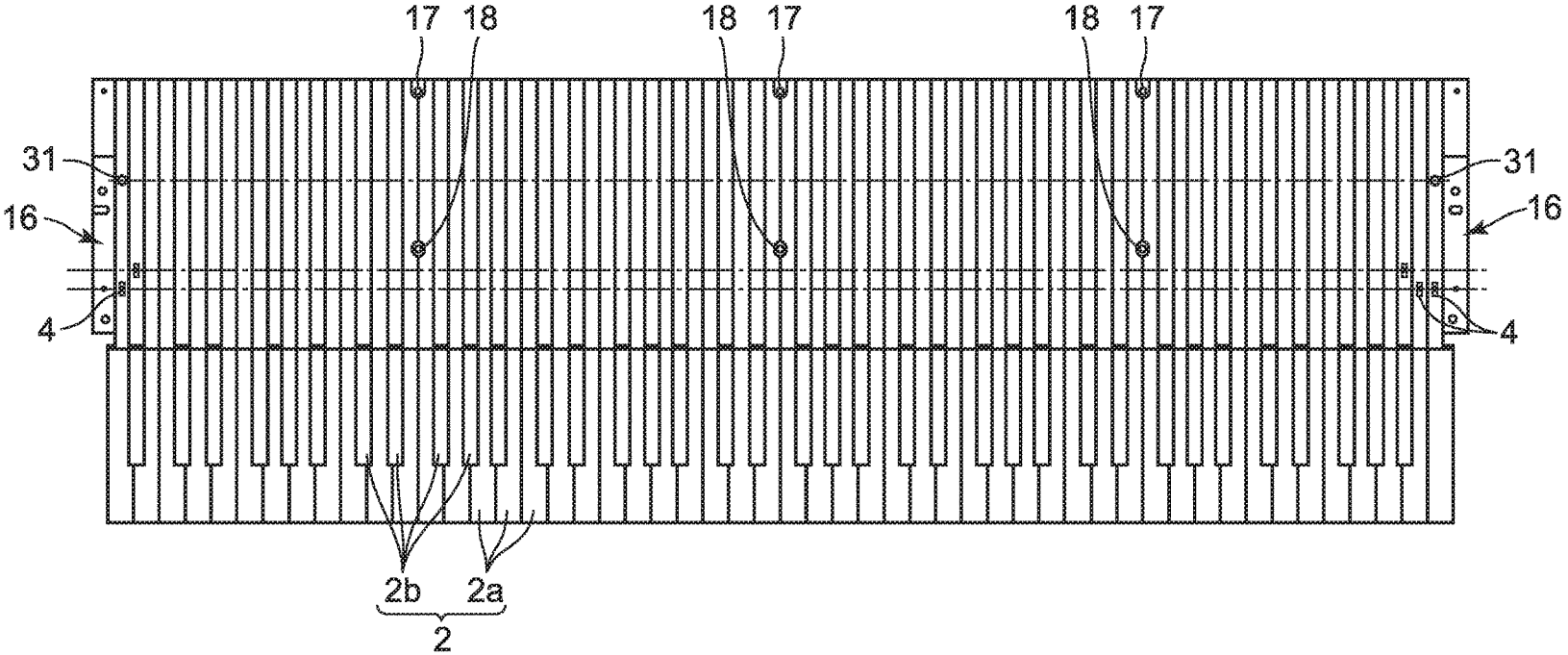
FIG. 3 is a planar view showing the keyboard device shown in FIG. 2.

The plurality of keys 2 include white keys 2*a* and black keys 2*b*, as shown in FIG. 1 to FIG. 3. The total number of white keys 2*a* and black keys 2*b* arranged in parallel is 88, for example. By a balance pin (balance key pin) 4*a* or 4*b* serving as a key support shaft, a substantially intermediate portion of each key 2 in a front and rear direction (a lateral direction in FIG. 2) is supported such that it is rotatable in a vertical direction. In this state, the keys 2 are arranged in parallel on a base plate 5.

In this embodiment, the white keys 2*a* and the black keys 2*b* have different lengths in the front and rear direction, and the lengths of the white keys 2*a* are larger than the lengths of the black keys 2*b*, as shown in FIG. 1 to FIG. 3. Accordingly, each white key 2*a* is supported to be rotatable in the vertical direction by the balance pin 4*a* serving as a key support shaft, and each black key 2*b* is supported to be rotatable in the vertical direction by the balance pin 4*b* serving as a key support shaft.

On the base plate 5, cushion members 6 for the white keys 2 and cushion members (not shown) for the black keys 2*b* with which the under surfaces of front end portions (right end portions in FIG. 2) of the plurality of keys 2 separably come in contact are provided along the array direction of the keys 2, as shown in FIG. 1 and FIG. 2. Also, on the base plate 5, cushion members 7 with which the under surfaces of rear end portions (left end portions in FIG. 2) of the plurality of keys 2 separably come in contact are provided along the array direction of the keys 2.

As a result, for each of the plurality of keys 2, a key stroke is set by a cushion member 6 on the front side and a cushion member 7 on the rear side, as shown in FIG. 1 and FIG. 2. Further, on the base plate 5, guide pins 8 for the white keys 2*a* and guide pins (not shown) for the black keys 2*b* for preventing the plurality of keys 2 from rolling in the array direction are provided upright.

The action mechanisms 3 include a plurality of transmission members 10 each of which is rotated in the vertical direction in response to a key depression operation on the corresponding one of the plurality of keys 2 and a plurality of hammer members 11 each of which is rotated in the vertical direction in response to the rotating motion of the corresponding one of the plurality of transmission members 10 and applies an action load to the corresponding one of the plurality of keys 2. In this embodiment, each key 2 is rotated in the counterclockwise direction around a balance pin 4*a* or 4*b* by the weight of the corresponding one of the plurality of transmission members 10, so that an initial load is applied to each key 2 by it being pressed up to its initial position.

Also, the action mechanisms 3 include a plurality of transmission holding members 12 each of which rotatably holds the corresponding one of the plurality of transmission members 10 and a plurality of hammer holding members 13 each of which rotatably holds the corresponding one of the plurality of hammer members 11. The plurality of transmission holding members 12 are mounted on a transmission support rail 14 arranged along the array direction of the keys 2. Also, the plurality of hammer holding members 13 are mounted on a hammer support rail 15 arranged along the array direction of the keys 2.

Both end portions of the transmission support rail 14 and both end portions of the hammer support rail 15 are supported by the rail support members 16 and arranged above the plurality of keys 2, as shown in FIG. 1 and FIG. 3. Each of the rail support members 16 is constituted by hard synthetic resin such as ABS (Acrylonitrile Butadiene Styrene) resin, and has a mounting section 15*a* mounted on the base plate 5 and a bridge section 16*b* integrally formed on the mounting section 16*a*.

As a result, the rail support members 16 are arranged in areas corresponding to rear portions of the plurality of keys 2 with the bridge sections 16*b* projecting above the keys 2 by the mounting sections 16*a* being mounted on side portions of the base plate 5 in the array direction of the keys 2. In this embodiment, on lower rear portions of the bridge sections 16*b*, i.e., on upper rear portions (upper left portions in FIG. 1) of the mounting sections 16*a*, transmission rail support sections 16*c* which, support the transmission support rail 14 are provided.

Also, on upper front portions (upper right portions in FIG. 1) of the bridge sections 16*b*, hammer rail support sections 16*d* which support the hammer support rail 15 is provided, as shown in FIG. 1. Further, stopper rail support sections 16*e* are provided on upper rear portions (upper left portions in FIG. 1) of the bridge sections 16*b*, and substrate rail support sections 16*f* are provided on upper portions of the bridge sections 16*b*.

In this embodiment, a plurality of predetermined portions of the transmission support rail 14 located over the entire length in the array direction of the keys 2 are supported by transmission support poles 17, as shown in FIG. 1 to FIG. 3. Also, a plurality of predetermined portions of the hammer support rail 15 located over the entire length in the array direction of the keys 2 are supported by hammer support poles 18, as in the case of the transmission support poles 17.

Figure 4:
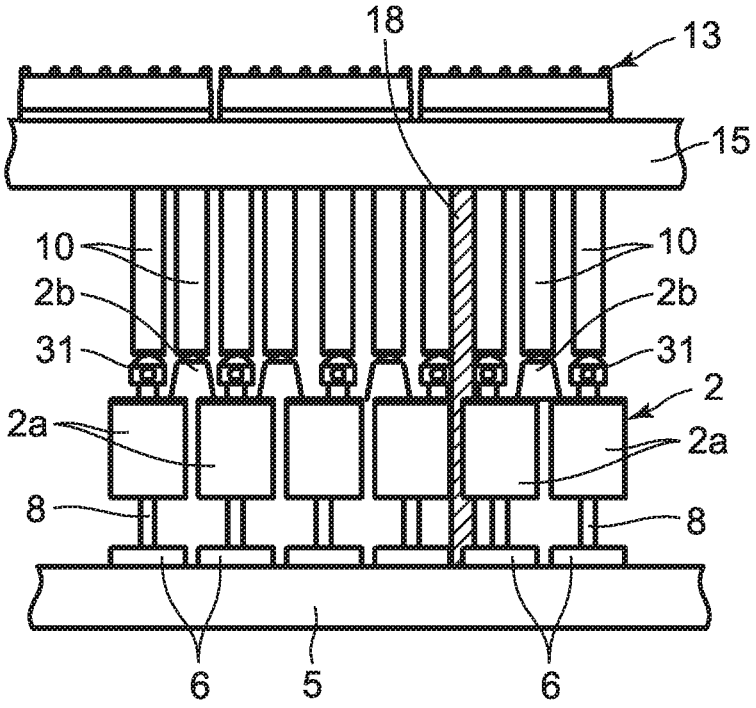
FIG. 4 is a front view of the main section of the keyboard device shown in FIG. 1 when viewed from the front.

In this embodiment, the plurality of keys 2 includes a total of 88 keys 2, as shown in FIG. 3 and FIG. 4. Accordingly, a plurality of transmission support poles 17 and a plurality of hammer support poles 18 are mounted upright on the base plate 5, and each of the transmission support poles 17 and each of the hammer support poles 18 are positioned between keys 2 in each of three areas located, for example, every twenty keys 2.

More specifically, each transmission support pole 17 is formed in a columnar shape as shown in FIG. 1 and FIG. 2, and its length in the vertical direction is equal to a length from the upper surface of the base plate 5 to the under surface of the transmission support rail 14, i.e., a length to an upper end portion of the transmission rail support section 16*c* of each rail support member 16. Also, each transmission support pole 17 is formed having an outer diameter smaller than the length (width) of each key 2 in the array direction of the keys 2.

Each transmission support pole 17 includes an upper transmission fastening section 20 which fixes its upper end portion to the transmission support rail 14 and a lower transmission fastening section 21 which fixes its lower end portion to the base plate 5, as shown in FIG. 1 and FIG. 2. The upper transmission fastening section 20 includes a screw hole 20*a* provided in an upper end portion of the transmission support pole 17 and a screw 20*b* to be screwed into the screw hole 20*a* in the transmission support pole 17 via a mounting hole 14*a* provided in a mounting section in a rear end portion of the transmission support rail 14.

Also, the lower transmission fastening section 21 includes a screw hole 21*a* provided in a lower end portion of the transmission support pole 17 and a screw 21*b* to be screwed into the screw hole 21*a* in the transmission support pole 17 via a stepped mounting hole 5*a* provided in the base plate 5, as shown in FIG. 1 and FIG. 2. In this embodiment, the stepped mounting hole 5*a* has a lower portion formed as a large-diameter hole section and an upper portion formed as a small-diameter hole section. When the screw 21*b* is inserted from below and screwed into the screw hole 21*a* in the transmission support pole 17, the head of the screw 21*b* is arranged inside the large-diameter hole section.

As a result of this structure, when each transmission support pole 17 is mounted on the base plate 5 upright by the corresponding one of the screws 21*b* being screwed into the screw hole 21*a* in the lower end portion of the transmission support pole 17 as shown in FIG. 1 and FIG. 2, the upper end portion of the transmission support pole 17 is arranged on the under surface of the transmission support rail 14, and the corresponding one of the screws 20*b* is screwed into the screw hole 20*a* in the upper end portion of the transmission support pole 17 via the corresponding mounting hole 14*a* of the transmission support rail 14.

As a result, the plurality of transmission support poles 17 support the plurality of predetermined areas (three areas) located in the key array direction on the transmission support rail 14 bridged over the transmission rail support sections 16*c* of the rail support members 16 arranged to the sides of the keys 2 in the array direction of the keys 2, as shown in FIG. 1 and FIG. 2.

On the other hand, as shown in FIG. 1 and FIG. 2, each hammer support pole 18 is formed in a columnar shape as with each transmission support pole 17, and its length in the vertical direction is equal to a length from the upper surface of the base plate 5 to the under surface of the hammer support rail 15, i.e., a length to an upper end portion of the hammer rail support section 16*d* of each rail support member 16. Also, each hammer support pole 18 is formed having an outer diameter smaller than the length (width) of each key 2 in the array direction of the keys 2.

Each hammer support pole 18 includes an upper transmission fastening section 22 which fixes its upper end portion to the hammer support rail 15 and a lower hammer fastening section 23 which fixes its lower end portion to the base plate 5, as shown in FIG. 1 and FIG. 2. The upper hammer fastening section 22 includes a screw hole 22*a* provided in an upper end portion of the hammer support pole 18 and a screw 22*b* to be screwed into the screw hole 22*a* in the hammer support pole 18 via a mounting hole 15*a* provided in the hammer support rail 15.

Also, the lower hammer fastening section 23 includes a screw hole 23*a* provided in a lower end portion of the hammer support pole 18 and a screw 23*b* to be screwed into the screw hole 23*a* in the hammer support pole 18 via a stepped mounting hole 5*b* provided in the base plate 5, as shown in FIG. 1. In this embodiment, the stepped mounting hole 5*b* has a lower portion formed as a large-diameter hole section and an upper portion formed as a small-diameter hole section. When the screw 23*b* is inserted from below and screwed into the screw hole 23*a* in the hammer support pole 18, the head of the screw 23*b* is arranged inside the large-diameter hole section.

As a result of this structure, when each hammer support pole 18 is mounted on the base plate 5 upright by the corresponding one of the screws 23*b* being screwed into the screw hole 23*a* in the lower end portion of the hammer support pole 18 as shown in FIG. 1, the upper end portion of the hammer support pole 18 is arranged on the under surface of the hammer support rail 15, and the corresponding one of the screws 22*b* is screwed into the screw hole 22*a* in the upper end portion of the hammer support pole 18 via the corresponding mounting hole 15*a* of the hammer support rail 15.

As a result, the plurality of hammer support poles 18 support the plurality of predetermined areas (three areas) located in the key array direction on the hammer support rail 15 bridged over the hammer rail support sections 16*d* of the rail support members 16 arranged to the sides of the keys 2 in the array direction of the keys 2, as shown in FIG. 1 and FIG. 2.

Figure 5A:
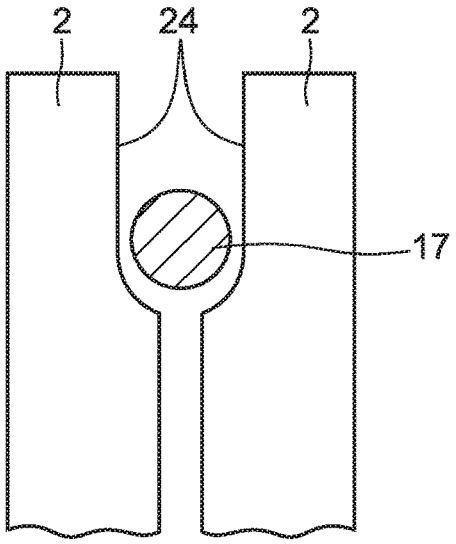
Figure 5B:
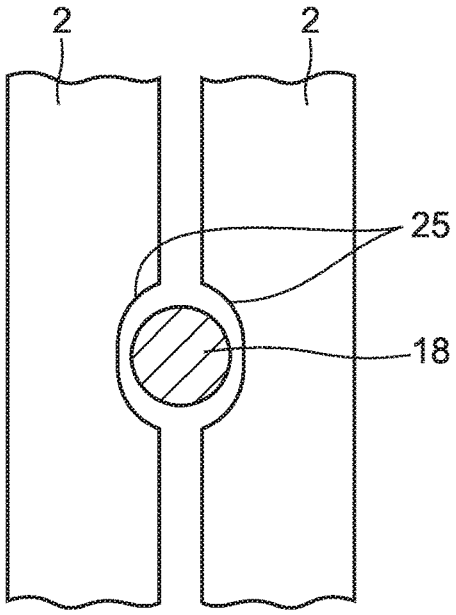

In this embodiment, each lower portion of the plurality of transmission support poles 17 and each lower portion of the plurality of hammer support poles 18 are arranged between keys 2 adjacent to each other in the plurality (three) areas located in the array direction of the keys 2, as shown in FIG. 3 to FIG. 5. More specifically, in the opposing surfaces of the keys 2 adjacent to each other, a pair of first notch sections 24 for arranging one transmission support pole 17 and a pair of second notch sections 25 for arranging one hammer support pole 18 are provided.

These paired first notch sections 24 are provided corresponding to each other in rear end portions of keys adjacent to each other in each area where the transmission support pole 17 is arranged, and extend from portions of the keys 2 where the transmission support pole 17 is positioned to the rear ends of the keys 2 with their notched portions having a length slightly larger than the radius of the transmission support pole 17, as shown in FIG. 3 to FIG. 5. As a result, the pair of first notch sections 24 is provided such that their opposing surfaces do not come in contact with the transmission support pole 17 when the lower part of the transmission support pole 17 is arranged therebetween.

Also, the paired second notch sections 25 are provided corresponding to each other in substantially intermediate portions of keys 2 adjacent to each other in each area where the hammer support pole 18 is arranged, and form a substantially trapezoidal shape whose notched portions have a length slightly larger than the radius of the hammer support pole 18, as shown in FIG. 3 to FIG. 5. As a result, the pair of second notch sections 25 is provided such that their opposing surfaces do not come in contact with the hammer support pole 18 when the lower part of the hammer support pole 18 is arranged therebetween.

Accordingly, the plurality of keys 2 are each formed upright and have a shape that is linear in their respective longitudinal direction, i.e., the direction perpendicular to the array direction of the keys 2, as shown in FIG. 3. In this case, by the pair of first notch sections 24 and the pair of second notch sections 25 being provided in keys 2 in each area where the corresponding ones of the plurality of transmission support poles 17 and the plurality of hammer support poles 18 are arranged, such as adjacent keys 2 in areas located every twenty keys 20, the plurality of keys 2 can be replaced for each block (e.g., for each octave).

The transmission support rail 14 has a shape formed by both side portions of a band plate being folded downward along its longitudinal direction, and its length in the longitudinal direction correspond to the entire length of the plurality of keys 2 in the array direction, as shown in FIG. 1. Plural portions of this transmission support rail 14 located in the array direction of the keys 2 are supported by the plurality of transmission support poles 17 with both sides of the transmission support rail 14 in the array direction of the keys 2 being mounted on the transmission rail support sections 16*c* of the rail support member 16.

On this transmission support rail 14, the plurality of transmission holding members 12 and the plurality of stopper support sections 26 are mounted along the array direction of the keys 2, as shown in FIG. 1. In this case, the plurality of stopper support sections 26 are each constituted by a metal plate, and are mounted in five areas on the transmission support rail 14 corresponding to the rail support members 16 positioned on both sides and the plurality of transmission support poles 17 with them projecting above the plurality of transmission holding members 12.

Figure 6A:
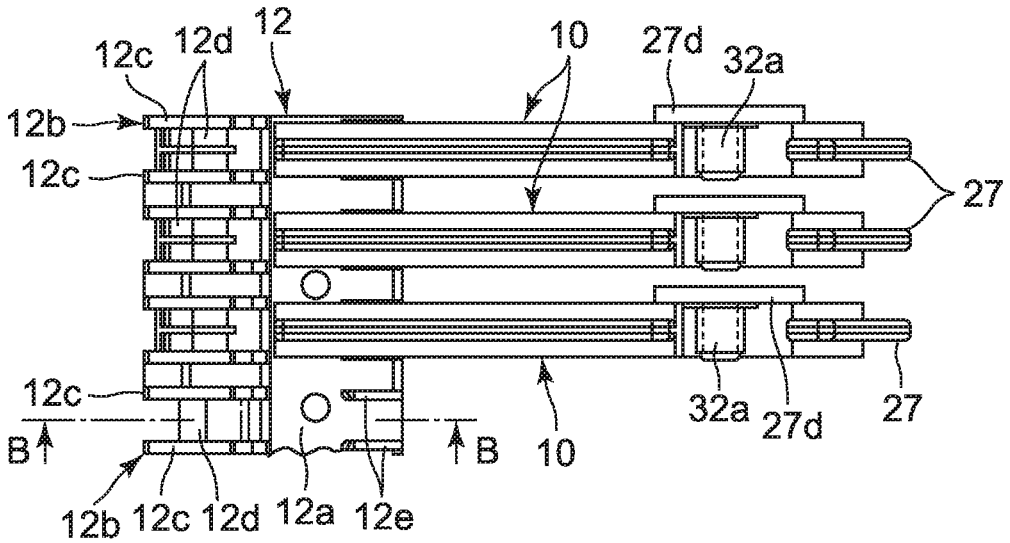
Figure 6B:
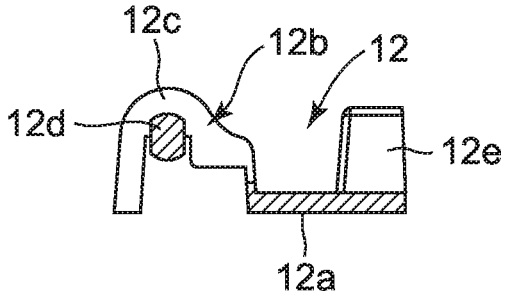

The transmission holding members 12 are each constituted by hard synthetic resin such as ABS resin, and are integrally provided along the array direction of the keys 2 with a plurality of shaft support sections 12*b* corresponding to, for example, ten keys 2 on a body plate 12*a*, as shown in FIG. 6A and FIG. 6B. Each of the shaft support sections 12*b* prevents the rolling of the corresponding transmission member 10 by the transmission member 10 being rotatably mounted thereon.

That is, each shaft support section 12*b* has a pair of guide walls 12*c* and a transmission holding shaft 12*d* provided between the pair of guide walls 12*c*, as shown in FIG. 6A and FIG. 6B. These guide walls 12*c* are provided corresponding to both sides of each of the plurality of transmission members 10, on a rear end portion (a left end portion in FIG. 6B) of the body plate 12*a* of the corresponding transmission holding member 12.

The pair of guide walls 12*c* serves as a guide section which rotatably guides a transmission fitting section 28 of the corresponding transmission member 10 with the transmission fitting section 28 of the transmission member 10 being slidably interposed therebetween, as shown in FIG. 6A. The transmission holding shaft 12*d* has a substantially round-bar shape, and has a non-circular shape in cross section because both sides of its outer peripheral surface are cut out, as shown in FIG. 6B.

Also, Each transmission holding member 12 includes a regulating section 12*e* which regulates the rolling of the corresponding transmission member 10 when the keyboard device 1 is packaged and transported, as shown in FIG. 6A and FIG. 6B. The regulating section 12*e* includes a pair of regulating walls provided on a front portion (a right side portion in FIG. 6A) of the body plate 12*a* of the transmission holding member 12 in a manner to correspond to the transmission member 10. The regulating section 12*e* regulates the rolling of the transmission member 10 when the keyboard device 1 is packaged and transported, in addition to rotatably guiding the transmission member 10 with a lower rear portion of the transmission member 10 being interposed therebetween.

Each transmission member 10 is constituted by hard synthetic resin such as ABS resin, and includes a transmission body section 27 which is rotated in the vertical direction in response to a key depression operation on the corresponding key 2 so as to rotate the corresponding hammer member 11 in the vertical direction, and a transmission fitting section 28 formed integrally with the transmission body section 27 and rotatably mounted on the transmission holding shaft 12*d* of the corresponding transmission holding member 12, as shown in FIG. 1 to FIG. 7.

The transmission body section 27 is formed in a substantially waffle shape, as shown in FIG. 1 and FIG. 7. That is, the transmission body section 27 has a thin vertical plate section 27*a* and a plurality of rib sections 27*b* provided in a substantially lattice shape on an outer peripheral portion and both side surfaces of the vertical plate section 27*a*, which form a waffle shape. In this case, the transmission body section 27 is structured such that the weight of the transmission member 10 is adjusted by the shape and thickness of the vertical plate section 27*a* and the formation density of the plurality of rib sections 27*b*.

Figure 7A:
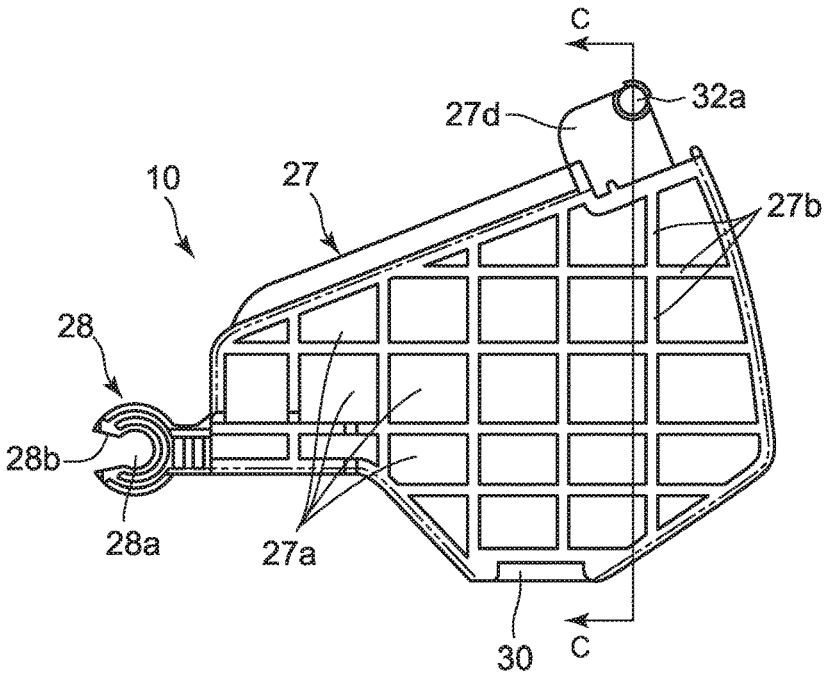
Figure 7B:
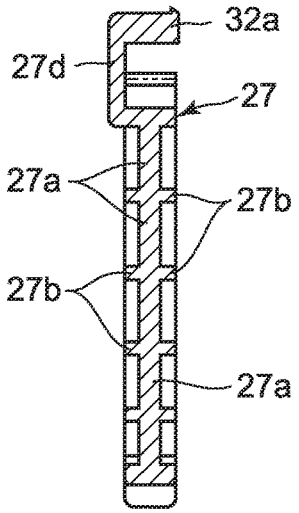

Also, each transmission member 10 is structured such that its rigidity is ensured by the plurality of rib sections 27*b* even though the vertical plate section 27*a* of the transmission body section 27 is thin, and that the occurrence of a shrink in the vertical plate section 27*a* when it is formed of synthetic resin is prevented by the plurality of rib sections 27*b*, as shown in FIG. 7A and FIG. 7B.

The transmission fitting section 28 is formed in an inverted C shape as a whole, and is provided projecting rearward on a rear end portion of the transmission body section 27, as shown in FIG. 1 and FIG. 7. That is, the transmission fitting section 28 is provided such that its thickness in the array direction of the keys 2 is substantially equal to a length between the pair of guide walls 12*c* of the corresponding shaft support section 12*b*, and is slidably inserted between the pair of guide walls 12*c*, as shown in FIG. 6 and FIG. 7.

Also, the transmission fitting section 28 has a fitting hole 28*a* which is provided in its center and into which the transmission holding shaft 12*d* of the transmission holding member 12 is to be fitted, and an insertion port 28*b* which is provided in its portion around the fitting hole 28*a*, i.e., its rear portion around the fitting hole 28*a* and into which the transmission holding shaft 12*d* is removably inserted, and is rotatably mounted on the transmission holding shaft 12*d* when the transmission holding shaft 12*d* is inserted into the fitting hole 28*a* through the insertion port 28*b*, as shown in FIG. 7A.

Also, a lower portion of the transmission body section 27 of the transmission member 10 projects toward the upper surface of the key 2, as shown in FIG. 1 and FIG. 7. In a lower end portion of the transmission body section 27, a transmission felt 30 is provided. This transmission felt 30 is structured such that a capstan 31 provided on an upper rear portion of the key 2 comes in contact therewith from below.

As a result, when the key 2 is depressed, the transmission member 10 is pressed upward by the capstan 31 on the key 2 coming in contact with the transmission felt 30 from below, and thereby rotated around the transmission holding shaft 12*d* in the counterclockwise direction, as shown in FIG. 1. Also, the transmission body section 27 of the transmission member 10 is provided such that its upper front end is higher than its upper rear end, and therefore its upper side portion is inclined downward at its rear end (at its left end in FIG. 1).

On the upper front end of the transmission body section 27, a support section 27*d* is provided projecting upward, as shown in FIG. 1 and FIG. 7. That is, the support section 27*d* is moved in the vertical direction along a side surface of the hammer member 11 without coming in contact with the hammer member 11. Also, on a side surface of the support section 27*d*, an interlock projecting section 32*a* of an interlock control section 32 described below is provided.

On the other hand, as with the transmission support rail 14, the hammer support rail 15 has a shape formed by both side portions of a band plate being folded downward along its longitudinal direction, and its length in the longitudinal direction corresponds to the entire length of the plurality of keys 2 in the array direction, as shown in FIG. 1. Plural portions of this hammer support rail 15 located in the array direction of the keys 2 are supported by the plurality of hammer support poles 18 with both sides of the hammer support rail 15 in the array direction of the keys 2 being mounted on the hammer rail support sections 16*d* of the rail support member 16.

On this hammer support rail 15, the plurality of hammer holding members 13 are mounted along the array direction of the keys 2, as shown in FIG. 1 and FIG. 8. The hammer holding members 13 are constituted by hard synthetic resin such as ABS resin, in each of which shaft support sections 13*b* are integrally provided with rear end portions of a rail-shaped body plate 13*a* whose top is open and located along the array direction of the keys 2 while opposing, for example, ten keys 2. Each of the shaft support sections 13*b* prevents the rolling of the corresponding hammer member 11 by the hammer member 11 being rotatably mounted thereon.

Figure 8A:
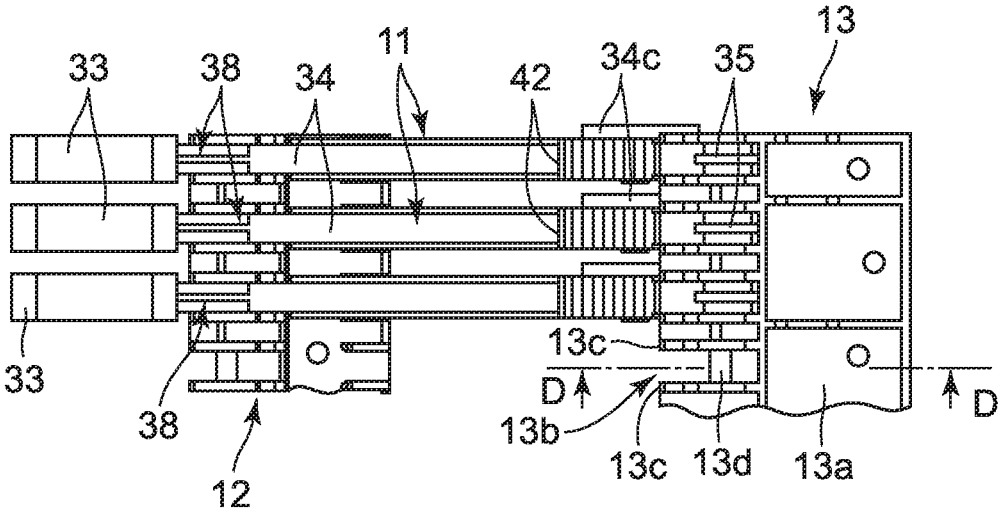
Figure 8B:
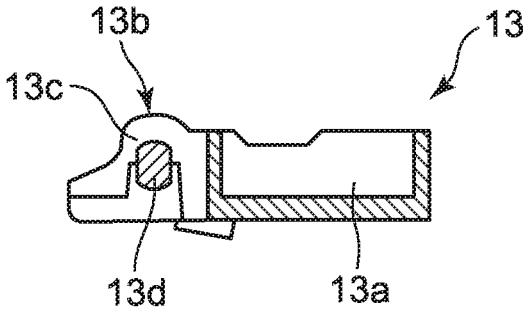

That is, each shaft support section 13*b* has a pair of guide walls 13*c* and a hammer holding shaft 13*d* provided between the pair of guide walls 13*c*, as shown in FIG. 8A and FIG. 8B. These guide walls 13*c* are provided corresponding to both sides of each of the plurality of hammer members 11, on rear end portions (left end portions in FIG. 8B) of the body plate 13*a*.

The pair of guide walls 13*c* serves as a guide section which rotatably guides a hammer fitting section 35 of the corresponding hammer member 11 with the hammer fitting section of the hammer member 11 being slidably interposed therebetween, as shown in FIG. 8A and FIG. 8B. As with each transmission holding shaft 12*d*, each hammer holding shaft 13*d* has a substantially round-bar shape, and has a non-circular shape in cross section because both sides of its outer peripheral surface are cut out, as shown in FIG. 3B.

Figure 9A:
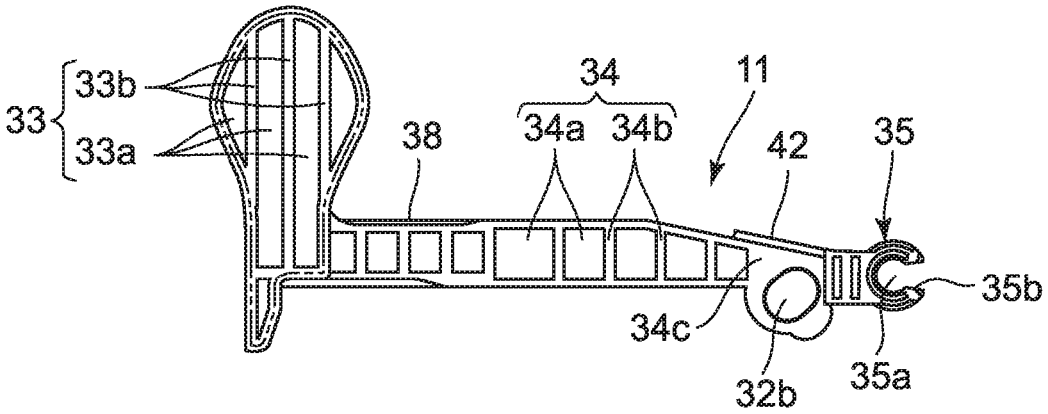
Figure 9B:
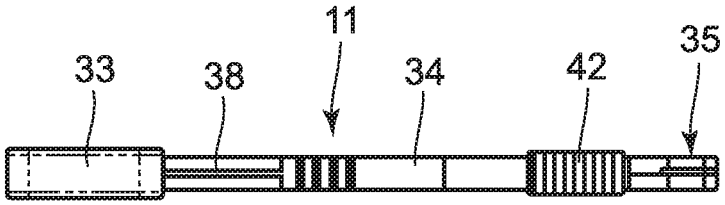

Each hammer member 11 is constituted by hard synthetic resin such as ABS resin, and includes a hammer head 33 and a hammer arm 34 which are integrally provided, as shown in FIG. 1 and FIG. 9. In this case, the hammer member 11 is provided with a stopper contact section 38 which comes in contact with an upper-limit stopper 40 described below, as shown in FIG. 9A and FIG. 9B.

The hammer head 33 has a scoop-shaped vertical plate section 33*a* and a plurality of rib sections 33*b* provided on its outer peripheral portion and side surfaces, as shown in FIG. 1 and FIG. 9. This hammer head 33 is structured such that the weight of the hammer member 11 is adjusted by the shape of the scoop-shaped vertical plate section 33*a*, and the formation density of the plurality of rib sections 33*b*.

The hammer arm 34 has a lateral plate section 34*a* whose length in the front and rear direction is substantially equal to that of each transmission member 10 and rib sections 34*b* provided on its outer peripheral portion and side surfaces, as shown in FIG. 1 and FIG. 9. On a front end portion (a right end portion in FIG. 9B) of the hammer arm 34, the hammer fitting section 35, which is rotatably mounted on the hammer holding member 13, is provided.

As with the transmission fitting section 28, this hammer fitting section 35 is formed in a C shape as a whole, and projects forward on the front end portion of the hammer arm 34, as shown in FIG. 9A. That is, the hammer fitting section 35 is provided such that its thickness in the array direction of the keys 2 is substantially equal to a length between the pair of guide walls 13*c*, and is slidably inserted between the pair of guide walls 13*c*.

Also, the hammer fitting section 35 has a fitting hole 35*a* which is provided in its center and into which the hammer holding shaft 13*d* of the hammer holding member 13 is fitted, and an insertion port 35*b* which is provided in its portion around the fitting hole 35*a*, i.e., its front portion around the fitting hole 35*a* and into which the hammer holding shaft 13*d* is removably inserted, and is rotatably mounted on the hammer holding shaft 13*d* when the hammer holding shaft 13*d* is inserted into the fitting hole 35*a* through the insertion port 35*b*, as shown in FIG. 9.

Also, on the lower front end of the hammer arm 34, a mounting section 34*c* is provided projecting downward, as shown in FIG. 1 and FIG. 9. More specifically, the mounting section 34*c* is opposed to a side surface of the support section 27*d* on the transmission member 10 and moved in the vertical direction along the side surface of the support section 27*d*. Also, the mounting section 34*c* is provided with an interlock hole 32*b* into which an interlock projecting section 32*a* of an interlock control section 32 described below is inserted.

Also, this hammer arm 34 is regulated at a lower-limit position serving as an initial position by its lower rear end coming in contact with a lower-limit stopper 36 from above, as shown in FIG. 1. More specifically, the lower-limit stopper 36 is formed of a cushion material such as felt.

This lower-limit stopper 36 is mounted on a lower-limit stopper rail 37 supported by the plurality of stopper support sections 26 provided on the transmission support rail 14, as shown in FIG. 1. As a result, by the lower rear end of the hammer arm 34 coming in contact with the lower-limit stopper 36 from above, the hammer member 11 is positionally regulated at the initial position with it being inclined downward at its rear end.

Also, the hammer arm 34 is structured such that its upper-limit position is regulated by the stopper contact section 38 on the upper rear end of the hammer arm 34 coming in contact with the upper-limit stopper 40 from below when the key 2 is depressed, as shown in FIG. 1 and FIG. 9. The upper-limit stopper 40 is formed of a cushion material such as felt, and is mounted on the under surface of an upper-limit stopper rail 41 bridged between the stopper rail support sections 16*e* of the rail support members 16 positioned on both sides.

As a result, the hammer member 11 is structured such that, when the hammer arm 34 is rotated around the hammer holding shaft 13*d* of the hammer holding member 13 in the clockwise direction, its upper-limit position is regulated by the upper rear end of the hammer arm 34 coming in contact with the upper-limit stopper 40 from below, as shown in FIG. 1. In this case, the upper-limit stopper rail 41 is formed by a band plate constituted by a metal being folded in a substantially inverted L shape in cross section, and is arranged over the entire length of the plurality of keys 2 in the array direction.

On the other hand, on the upper front end of the hammer arm 34, a switch pressing section 42 is provided, as shown in FIG. 1 and FIG. 9. Above an area corresponding to the switch pressing section 42 on the hammer arm 34, a switch substrate 43 is arranged by a pair of substrate support rails 44. These substrate support rails 44 are long plates each formed in an L shape in cross section, and are provided such that their lengths correspond to the entire length of the keys 2 in the array direction.

The pair of substrate support rails 44 is mounted with their respective horizontal portions being away from each other by a predetermined distance, on the substrate support rail sections 16*f* of the plurality of support members 16 positioned on both sides, as shown in FIG. 1. The switch substrate 43 includes a plurality of switch substrates 43. That is, in the present embodiment, the switch substrate 43 is divided into four switch substrates 43 each having a length corresponding to about twenty keys 2, and mounted on the pair of substrate support rails 44.

On the under surface of each switch substrate 43, rubber switches 45 are provided, as shown in FIG. 1. Each rubber switch 45 has an inverted-dome-shaped bulging section 45*a* provided on a rubber sheet elongated in the array direction of the keys 2 in a manner to correspond to each switch pressing section 42 on the corresponding hammer arms 34. In the bulging section 45*a*, a plurality of movable contacts (not shown) which separably come in contact with a plurality of fixed contacts (not shown) on the under surface of the switch substrate 43 are provided along the front and rear direction of the hammer arms 34.

As a result of this structure, each rubber switch 45 outputs when the corresponding hammer member 11 is rotated around the hammer holding shaft 13*d* of the hammer holding member 13 in the clockwise direction and the rubber switch 45 is pressed from below by the switch pressing section 42 on the hammer arm 34, a switch signal corresponding to the strength of the key depression on the key 2 by the corresponding inverted-dome-shaped bulging section 45*a* being elastically deformed and the plurality of movable contacts therein sequentially coming in contact with the corresponding fixed contacts with time, as shown in FIG. 1. This switch signal is supplied to a sound source section 43*a*, and a musical sound corresponding to the strength of the key depression on the key 2 is generated.

The interlock control section 32 has the interlock projecting section 32*a* which is provided on the support section 27*d* on the transmission member 10 and the interlock hole 32*b* which is provided in the mounting section 34*c* of the hammer member n and into which the interlock projecting section 32*a* is inserted, as shown in FIG. 1, FIG. 7, and FIG. 9. As a result of this structure, by the interlock projecting section 32*a* and the interlock hole 32*b*, the interlock control section 32 rotates the hammer member 11 along with the rotating motion of the transmission member 10 corresponding to the depressed key 2.

Next the operation of the above-described keyboard device 1 in the electronic keyboard instrument is described.

When the keyboard device 1 enters an initial state where no key depression operation is performed on the keys 2, each transmission member 10 rotates by its self weight around the transmission holding shaft 12*d* of the transmission holding section 12 in the clockwise direction, and the transmission felt 30 provided on the under surface of the transmission body section 27 comes in contact with the capstan 31 on the corresponding key 2 from above.

Here, the weight of the transmission member 10, that is, the weight set by the shape and the thickness of the vertical plate section 27*a* of the transmission body section 27 and the formation density of the plurality of rib sections 27*b* is applied to the capstan 31 on the key 2 from above. As a result, the key 2 is depressed by the transmission member 10 to rotate around the balance pins 4*a* and 4*b* in the counterclockwise direction, and the rear end portion of the key 2 comes in contact with the cushion member 7 to regulate the key 2 at its initial position while regulating the transmission member 10 at its initial position.

Also, here, each hammer member 11 rotates by its self weight around the hammer holding shaft 13*d* of the hammer holding member 13 in the counterclockwise direction, and the hammer arm 34 comes in contact with the lower-limit stopper 36 and is positionally regulated at the lower-limit position. In this state, the switch pressing section 42 on the hammer member 11 is arranged at a position below and away from the rubber switch 45 on the switch substrate 43. As a result, the rubber switch 45 is in a free state where the bulging section 42*a* has bulged, and is also in an OFF state by the plurality of movable contacts being away from the fixed contacts (not shown).

Next, a case where a key 2 is depressed in the above-described state so as to perform a musical performance is described.

In this case, when a key 2 is depressed, this key 2 is rotated around the balance pins 4*a* and 4*b* in the clockwise direction in FIG. 1, and the capstan 31 on the key 2 presses the transmission member 10 upward. Here, the weight of the transmission member 10 set by the shape and thickness of the vertical plate section 27*a* of the transmission body section 27 and the formation density of the plurality of rib sections 27*b* is applied to the key 2 as an initial load.

As a result, the transmission member 10 is rotated against its self weight around the transmission holding shaft 12*d* of the transmission holding member 12 in the counterclockwise direction in FIG. 1. Then, the rotating motion of the transmission member 10 is transmitted to the hammer member 11 by the interlock control section 32, and the hammer member 11 is pressed upward against its self weight That is, when the transmission member 10 is rotated in the counterclockwise direction in FIG. 1, the transmission member 10 presses the interlock hole 32*b* upward with the interlock projecting section 32*a* coming in contact with the inner peripheral surface of the interlock hole 32*b* by the rotation of the transmission member 10.

As a result, the hammer member 11 is rotated around the hammer holding shaft 13*d* of the hammer holding member 13 in the clockwise direction in FIG. 1, and applies an action load to the key 2. That is, when the hammer member 11 is rotated around the hammer holding shaft 13*d* in the clockwise direction in FIG. 1, an action load is applied to the key 2 by the moment of inertia of the hammer member 11. In this embodiment, the hammer arm 34 has been formed such that the length in the front and rear direction of the key 2 is substantially equal to the length of the transmission member 10, and the hammer head 33 has been provided on the rear end of the hammer arm 34, as shown in FIG. 1.

The hammer fitting section 35 on the hammer arm 34 has been rotatably mounted on the hammer holding shaft 13*d* in this state. Accordingly, when the hammer member 11 is rotated around the hammer holding shaft 13*d* in the clockwise direction, a moment of inertia occurs in the hammer member 11. A load caused by this moment of inertia is applied as an action load to the key 2 via the interlock control section 32 and the transmission member 10. As a result, a key-touch feel close to that of an acoustic piano can be acquired.

When the hammer member 11 is rotated as described above around the hammer holding shaft 13*d* in the clockwise direction, the switch pressing section 42 on the hammer arm 34 presses the inverted-dome-shaped bulging section 45*a* of the rubber switch 45 provided on the switch substrate 43 from below, as shown in FIG. 1. As a result, the inverted-dome-shaped bulging section 45*a* is elastically deformed, and the plurality of movable contacts 42*b* in the bulging section 45*a* sequentially comes in contact with the plurality of fixed contacts at time intervals.

Here, a switch signal corresponding to the depressed key 2 is supplied to the sound source section 43*a*, and musical sound data is generated in the sound source section 43*a*. Then, based on the generated musical sound data, a musical sound is emitted from a loudspeaker (not shown) serving as a sound emitting section. When the hammer member 11 is further rotated around the hammer holding shaft 13*d* in the clockwise direction, the hammer arm 34 comes in contact with the upper-limit stopper 40 from below to regulate and stop the rotation of the hammer member 11.

Then, when a key release motion (returning motion) for returning the key 2 to its initial position is started, the hammer member 11 is rotated by its self weight in the clockwise direction to return to its initial position and the transmission member 10 is rotated by its self weight in the clockwise direction to return to its initial position with the interlock projecting section 32*a* of the interlock control section 32 being inserted into the interlock hole 32*b* to connect the hammer member 11 and the transmission member 10 to each other. Here, the transmission felt 30 on the transmission member 10 presses the capstan 31 on the key 2 downward and rotates the key 2 in the counterclockwise direction. As a result, the key 2 returns to its initial position.

As described above, the keyboard device 1 in this electronic keyboard instrument includes the plurality of keys 2 including at least a key 2 having the notch section 24 or a key 2 supported by the balance pins 4*a* and 4*b* serving as key support shafts, the transmission support rail 14 that holds the plurality of transmission members 10 each of which is rotated in response to a key depression operation on the corresponding one of the plurality of keys 2, along the array direction of the keys 2, and the transmission support pole 17 which is arranged in the notch section 24 of the key 2 to support the transmission support rail 14, whereby the transmission support rail 14 can be reliably and favorably supported and prevented from being bent even though the length of the transmission support rail 14 in the array direction of the keys 2 is long.

That is, in the keyboard device 1 in this electronic keyboard instrument the plurality of transmission support poles 17 can support predetermined portions of the transmission support rail 14 in the array direction of the keys 2. Therefore, even though the length of the transmission support rail 14 in the array direction of the keys 2 is large, the transmission support rail 14 can be reliably and favorably supported. As a result, the transmission support rail 14 can be prevented from being bent and from being vibrated due to the rotating motions of the plurality of transmission members 10.

Also, the keyboard device 1 in this electronic keyboard instrument includes the plurality of keys 2 including at least a key 2 having the notch section 25 or a key 2 supported by the balance pins 4*a* and 4*b* serving as key support shafts the hammer support rail 15 for holding, along the array direction of the keys 2, the plurality of hammer members 11 which are rotated in response to the rotations of the plurality of transmission members 10 that are rotated in response to key depression operations on the keys 2 and apply action loads to the keys 2, and the hammer support poles 18 which are arranged corresponding to the notch sections 25 of keys 2 to support the hammer support rail 15, whereby the hammer support rail 15 can be reliably and favorably supported and prevented from being bent even though the length of the hammer support rail 15 in the array direction of the keys 2 is large by the plurality of keys 2 being included.

That is, in the keyboard device 1 in this electronic keyboard instrument, the plurality of hammer support poles 18 can support predetermined portions of the hammer support rail 15 in the array direction of the keys 2. Therefore, even though the length of the hammer support rail 15 in the array direction of the keys 2 is large, the hammer support rail 15 can be reliably and favorably supported. As a result, the hammer support rail 15 can be prevented from being bent and from being vibrated due to the rotating motions of the plurality of hammer members 11.

In this embodiment, each of the plurality of transmission support poles 17 includes the upper transmission fastening section 20 which fixes its upper end portion to the transmission support rail 14 and the lower transmission fastening section 21 which fixes its lower end portion to the base plate 5 where the plurality of keys 2 are arranged by the balance pins 4*a* and 4*b*. Therefore, the upper end portion of the transmission support pole 17 can be reliably fixed to the transmission support rail 14 by the upper transmission fastening section 20 and the lower end portion of the transmission support pole 17 can be reliably fixed to the base plate 5 by the lower transmission fastening section 21.

That is the upper transmission fastening section 20 includes the screw hole 20*a* provided in the upper end portion of the transmission support pole 17 and the screw 20*b* to be screwed into the screw hole 20*a* in the transmission support pole 17 via the mounting hole 14*a* of the transmission support rail 14. Therefore, when the screw 20*b* is screwed into the screw hole 20*a* in the transmission support pole 17 via the mounting hole 14*a* of the transmission support rail 14, the transmission support rail 14 can be reliably and rigidly fixed to the upper end portion of the transmission support pole 17.

Also, the lower transmission fastening section 21 includes the screw hole 21*a* provided in the upper end portion of the transmission support pole 17 and the screw 21*b* to be screwed into the screw hole 21*a* in the transmission support pole 17 via the stepped mounting hole 5*a* provided in the base plate 5. Therefore, when the screw 21*b* is screwed into the screw hole 21*a* in the transmission support pole 17 via the mounting hole 5*a* of the transmission support rail 5, the lower end portion of the transmission support rail 17 can be reliably and rigidly fixed to the base plate 5.

On the other hand, each of the plurality of hammer support poles 18 includes the upper hammer fastening section 22 which fixes its upper end portion to the hammer support rail 15 and the lower hammer fastening section 23 which fixes its lower end portion to the base plate 5. Therefore, the upper end portion of the hammer support pole 18 can be reliably fixed to the hammer support rail 15 by the upper hammer fastening section 22 and the lower end portion of the hammer support pole 18 can be reliably fixed to the base plate 5 by the lower hammer fastening section 23.

That is, the upper hammer fastening section 22 includes the screw hole 22*a* provided in the upper end portion of the hammer support pole 18 and the screw 22*b* to be screwed into the screw hole 22*a* in the hammer support pole 18 via the mounting hole 15*a* of the hammer support rail 15. Therefore, when the screw 22*b* is screwed into the screw hole 22*a* in the hammer support pole 18 via the mounting hole 15*a* of the hammer support rail 15, the hammer support rail 15 can be reliably and rigidly fixed to the upper end portion of the hammer support pole 18.

Also, the lower hammer fastening section 23 includes the screw hole 23*a* provided in the lower end portion of the hammer support pole 18 and the screw 23*b* to be screwed into the screw hole 23*a* in the hammer support pole 18 via the stepped mounting hole 5*b* provided in the base plate 5. Therefore, when the screw 23*b* is screwed into the screw hole 23*a* in the hammer support pole 18 via the mounting hole 5*b* of the base plate 5, the lower end portion of the hammer support rail 18 can be reliably and rigidly fixed to the base plate 5.

Also, in the keyboard device 1 in this electronic keyboard instrument the plurality of transmission support poles 17 are provided on the plurality of portions of the transmission support rail 14 in the array direction of the keys 2 except for both ends of the transmission support rail 14. Therefore, even though the length of the transmission support rail 14 is large, the transmission support rail 14 can be reliably supported. For example, in the case where the number of keys 2 arranged in parallel is 88, the transmission support rail 14 can be reliably and rigidly supported by the transmission support poles 17 being provided for the plurality of areas located every twenty keys 2.

In this embodiment the end portions of the transmission support rail 14 are supported by the rail support members 16 mounted on the side portions of the base plate 5 in the array direction of the keys 2. As a result, the end portions of the transmission support rail 14 can be reliably fixed by the rail support members 16 positioned on both sides. Therefore, even though the plurality of transmission support poles 17 are each formed in a round-bar shape, the transmission support rail 14 can be reliably supported.

Also, the plurality of hammer support poles 18 are provided on the plurality of portions of the hammer support rail 15 in the array direction of the keys 2 except for both ends of the hammer support rail 15. Therefore, even though the length of the hammer support rail 15 is large, the hammer support rail 15 can be reliably supported. For example, in the case where the number of keys 2 arranged in parallel is 88, the hammer support rail 15 can be reliably and rigidly supported by the hammer support poles 18 being provided in the plurality of areas located every twenty keys 2.

In this case as well, the end portions of the hammer support rail 15 are supported by the rail support members 16 mounted on the side portions of the base plate 5 in the array direction of the keys 2. As a result, the end portions of the hammer support rail 15 can be reliably fixed by the rail support members 16 positioned on both sides. Therefore, even though the plurality of hammer support poles 18 are each formed in a round-bar shape, the hammer support rail 15 can be reliably supported.

Also, for the keyboard device 1 in this electronic keyboard instrument, the outer diameters of the transmission support poles 17 and the outer diameters of the hammer support poles 18 are formed smaller than the length (width) of each key 2 in the array direction of the keys 2. Accordingly, the lower portion of each of the plurality of transmission support poles 17 and the lower portion of each of the plurality of hammer support poles 18 can be arranged between the first notch sections 24 and between the second notch sections 25 in the adjacent keys 2 in the plurality of areas located in the array direction of the keys 2 without the keys 2 being bent or cut. As a result of this structure, the plurality of keys 2 can be compactly arranged, so that the entire keyboard device 1 can be downsized.

That is, the first notch sections 24 are provided corresponding to each other in the opposing surfaces of the adjacent keys 2 in the areas where the transmission support poles 17 are positioned. As a result, each transmission support pole 17 can be favorably arranged between the first notch sections 24. Also, the second notch sections 25 are provided corresponding to each other in the opposing surfaces of the adjacent keys 2 in the areas where the hammer support poles 18 are positioned. As a result, each hammer support pole 18 can be favorably arranged between the second notch sections 25.

In this embodiment, the first notch sections 24 of adjacent keys 2 between which a transmission support pole 17 is arranged are provided corresponding to each other in the rear end portions of the keys 2 and extend from portions of the keys 2 where the transmission support pole 17 is positioned to the rear ends of the keys 2 with their notched portions having a length slightly larger than the radius of the transmission support pole 17. As a result, when the lower portion of the transmission support pole 17 is arranged between the first notch sections 24, the opposing surfaces of the first notch sections 24 can be prevented from coming in contact with the transmission support pole 17. Therefore, the keys 2 can be smoothly and favorably pressed.

Similarly, the second notch sections 25 of adjacent keys 2 between which a hammer support pole 18 is arranged, are provided corresponding to each other in substantially intermediate portions of the keys 2, and form a substantially trapezoidal shape whose notched portions have a length slightly larger than the radius of the hammer support pole 18. As a result, when the lower portion of the hammer support pole 18 is arranged between the second notch sections 25, the opposing surfaces of the second notch sections 25 can be prevented from coming in contact with the hammer support pole 18. Therefore, the keys 2 can be smoothly and favorably pressed.

Furthermore, in this keyboard device 1, the plurality of keys 2 are formed upright and have a shape that is linear in the direction perpendicular to the array direction of the keys 2. Accordingly, in the case where the number of keys 2 arranged in parallel is 88, it is only required that the first notch sections 24 and the second notch sections 25 are provided in only adjacent keys 2 positioned every twenty keys 2. As a result of this structure, twenty keys 2 can be assembled on the base plate 5 at one time, which improves the assembling workability.

In the above-described embodiment, the hammer support poles 18 are provided separately from the balance pins 4*a* and 4*b* serving as key support shafts. However, the present invention is not limited thereto. Far example, a structure 10 may be adopted in which each hammer support pole 50 is provided integrally with a balance pin 4*b* in a black key 2*b*, as shown in a modification example in FIG. 10. More specifically, this hammer support pole 50 is structured such that the balance pin 4*b* is provided projecting above the key 2 and an upper hammer fastening section 51 is provided on its upper end portion.

Figure 10:
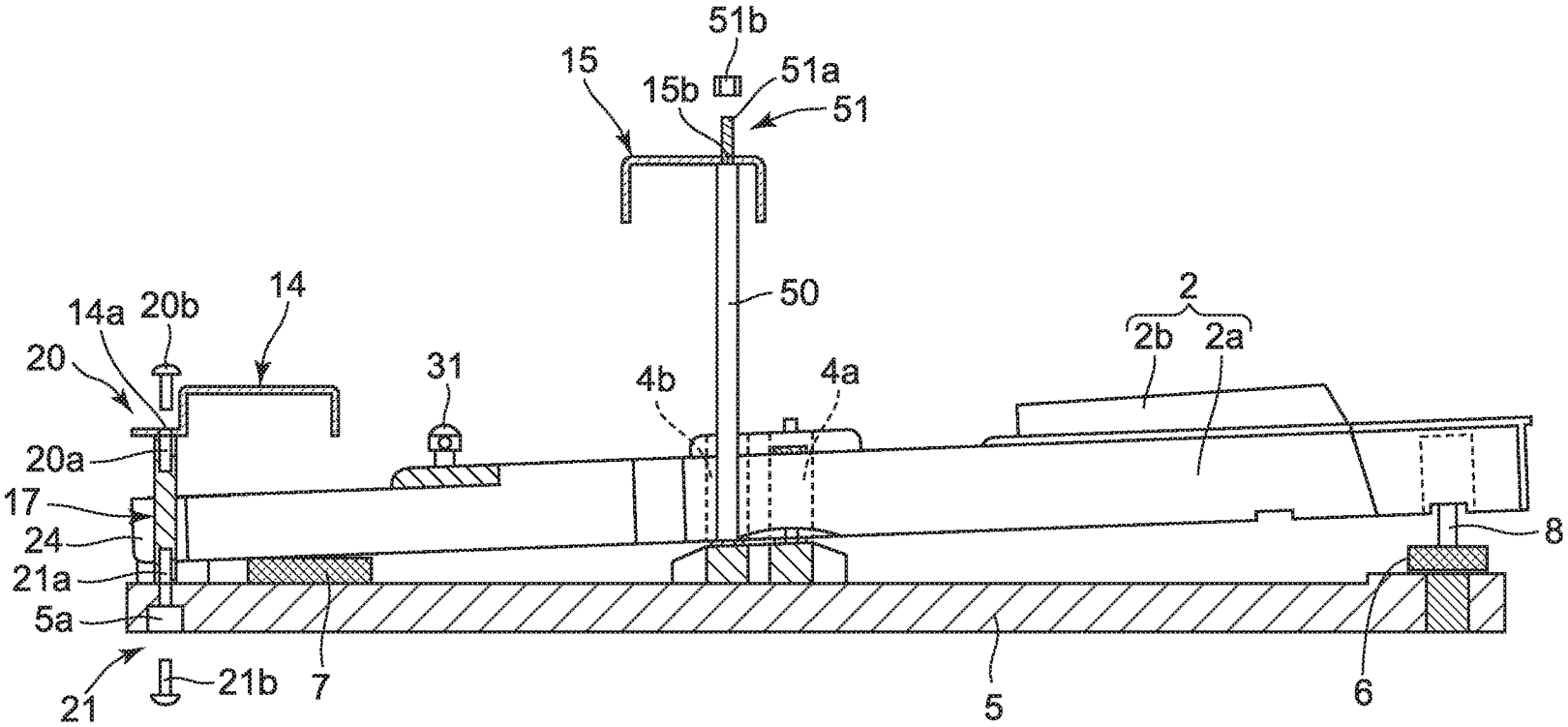
FIG. 10 is a cross-sectional view showing a modification example of the keyboard device in which the present invention has been applied.

In this structure, the hammer support pole 50 extends above the key 2 with the balance pin 4*b* being fixed to the base plate 5 so as to support the key 2 in a manner to be rotatable in the vertical direction, and the upper end portion of the hammer support pole 50 is arranged on the under surface of the hammer support rail 15, as shown in FIG. 10. Also, the upper hammer fastening section 51 on the hammer support pole 50 includes a screw section 51*a* provided on the upper end portion of the hammer support pole 50 and inserted into a mounting hole 15*b* in the hammer support rail 15 and a nut 51*b* to be screwed into the screw section 51*a*.

As a result, the upper hammer fastening section 51 fixes the hammer support rail 15 to the upper end portion of the hammer support pole 50 by the screw section 51*a* being inserted into the mounting hole 15*b* in the hammer support rail 15 from below and protruded upward with the balance pin 4*b* being fixed to the base plate 5 to support the key 2 to be rotatable in the vertical direction and by the nut 51*b* being tightened and attached to the projecting screw section 51*a*, as shown in FIG. 10.

With this keyboard device 1 having the structure where each hammer support pole 50 is provided integrally with a balance pin 4*b* in a black key 2*b*, an advantageous effect similar to that of the above-described embodiment can be acquired, whereby the number of components can be reduced and assembling work can be simplified. In addition, by each upper hammer fastening section 51, the hammer support rail 15 can be reliably fixed to the upper end portion of each hammer support pole 50.

That is, this upper hammer fastening section 51 includes the screw section 51*a* provided on the upper end portion of the hammer support pole 50 and inserted into the mounting hole 15*b* in the hammer support rail 15. Therefore, by the screw section 51*a* on the hammer support pole 50 being inserted into the mounting hole 15*b* in the hammer support rail 15 so as to protrude therefrom, and by the nut 51*b* being tightened and attached to the projecting screw section 51*a*, the upper hammer fastening section 51 can reliably and rigidly fix the hammer support rail 15 to the upper end portion of the hammer support pole 18.

In the above-described modification example, each hammer support pole 50 is integrally provided with a balance pin 4*b* in a black key 2*b*. However, the present invention is not limited thereto. For example, a structure may be adopted, in which each hammer support pole 50 is integrally provided with a balance pin 4*a* in a white key 2*a*. Also, a structure may be adopted in which each transmission support pole 17 is integrally provided with a balance pin 4*a* in a white key 2*a* or a balance pin 4*b* in a black key 2*b*.

In the above-described embodiment, the upper transmission fastening section 20 and the lower transmission fastening section 21 of each transmission support pole 17 and the upper hammer fastening section 22 and the lower hammer fastening section 23 of each hammer support pole 13 include the screw holes 20*a* to 23*a* and the screws 20*b* to 23*b*. However, the present invention is not limited thereto. For example, a structure may be adopted in which each of the fastening sections 20, 21, 22, and 23 includes a screw section and a nut, as with each upper hammer fastening section 51 in the above-described modification example.

Also, in the above-described embodiment, the first notch sections 24 between which a transmission support pole 17 is arranged and the second notch sections 25 between which a hammer support port 18 is arranged are provided on the opposing surfaces of adjacent keys 2. However, the present invention is not limited thereto. For example, a structure may be adopted in which a first through hole where a transmission support pole 17 is arranged and a second through hole where a hammer support pole 18 is arranged are provided in a key 2.

Furthermore, in the above-described embodiment, the rail support members 16 includes a first rail support member 16 and a second rail support member 16 provided to the sides of the ends of the transmission support rail 14 and the ends of the hammer support rail 15 (to the sides in the array direction of the plurality of keys 2). No other rail support member 16 is provided between the first rail support member 16 and the second rail support member 16. Also, each of the plurality of keys 2 has a shape that is linear in the direction perpendicular to the array direction of the keys 2. Moreover, each transmission support pole 17 and each hammer support pole 18 are (i) arranged in a gap between two keys 2 adjacent to each other among the plurality of keys 2, (ii) arranged in a hole provided in at least one of the plurality of keys 2, or (iii) arranged at a position corresponding to a key support shaft which supports at least one of the plurality of keys 2. Therefore, the entire keyboard device 1 can be downsized.

While the present invention has been described with reference to the preferred embodiments, it is intended that the invention be not limited by any of the details of the description therein but includes all the embodiments which fall within the scope of the appended claims.

What is claimed is:

1. A keyboard device comprising:

a plurality of keys;

a transmission rail which holds a plurality of transmission members that are rotated in response to key depression operations on the plurality of keys, along an array direction of the keys; and a transmission support pole which supports the transmission rail, wherein the transmission support pole is (i) arranged in a gap between two keys adjacent to each other among the plurality of keys, (ii) arranged in a hole provided in at least one of the plurality of keys, or (iii) arranged at a position corresponding to a key support shaft which supports at least one of the plurality of keys.

2. The keyboard device according to claim 1, wherein both ends of the transmission rail are supported by rail support members, and wherein the transmission support pole is provided on at least one portion of the transmission rail between the rail support members excluding the both ends of the transmission rail.

3. The keyboard device according to claim 1, wherein an outer diameter of the transmission support pole is smaller than a length of each key in the array direction of the keys.

4. The keyboard device according to claim 1, wherein the plurality of keys each have a shape that is linear in a direction perpendicular to the array direction.

5. A keyboard device comprising:

a plurality of keys;

a hammer rail which holds a plurality of hammer members that are rotated in response to key depression operations on the plurality of keys, along an array direction of the keys; and a hammer support pole which supports the hammer rail, wherein the hammer support pole is (i) arranged in a gap between two keys adjacent to each other among the plurality of keys, (ii) arranged in a hole provided in at least one of the plurality of keys, or (iii) arranged at a position corresponding to a key support shaft which supports at least one of the plurality of keys.

6. The keyboard device according to claim 5, wherein both ends of the hammer rail are supported by rail support members, and wherein the hammer support pole is provided on at least one portion of the hammer rail between the rail support members excluding the both ends of the hammer rail.

7. The keyboard device according to claim 5, wherein an outer diameter of the hammer support pole is smaller than a length of each key in the array direction of the keys.

8. The keyboard device according to claim 5, wherein the plurality of keys each have a shape that is linear in a direction perpendicular to the array direction.

9. A keyboard instrument comprising:

the keyboard device according to claim 1; and a sound emitting section which emits a musical sound in response to a key operation on the keyboard device.

10. A keyboard device comprising:

a plurality of keys;

a transmission rail which holds a plurality of transmission members that are rotated in response to key depression operations on the plurality of keys, along an array direction of the keys; and a transmission support pole which supports the transmission rail, a hammer rail which holds a plurality of hammer members that are rotated in response to the key depression operations on the plurality of keys, along the array direction of the keys; and a hammer support pole which supports the hammer rail, wherein the transmission support pole is (i) arranged in a gap between two keys adjacent to each other among the plurality of keys, (ii) arranged in a hole provided in at least one of the plurality of keys, or (iii) arranged at a position corresponding to a key support shaft which supports at least one of the plurality of keys, and wherein the hammer support pole is (i) arranged in a gap between two keys adjacent to each other among the plurality of keys, (ii) arranged in a hole provided in at least one of the plurality of keys, or (iii) arranged at a position corresponding to a key support shaft which supports at least one of the plurality of keys.

11. The keyboard device according to claim 10, further comprising:

rail support members which are provided to sides of the plurality of keys in the array direction of the keys so as to support the transmission rail and the hammer rail, wherein at least one transmission support pole and one hammer support pole are provided between the rail support members.

12. The keyboard device according to claim 10, wherein an outer diameter of the transmission support pole and an outer diameter of the hammer support pole are smaller than a length of each key in the array direction of the keys.

13. The keyboard device according to claim 10, wherein the plurality of keys each have a shape that is linear in a direction perpendicular to the array direction.

* * * * *